US005853247A

United States Patent [19]

Shroyer

[11] Patent Number: 5,853,247

[45] Date of Patent: Dec. 29, 1998

[54] SAMPLE BAG CONTAINER

[76] Inventor: John Bruce Shroyer, 306 Aerie Ct., Manhasset, N.Y. 11030

[21] Appl. No.: 864,023

[22] Filed: May 27, 1997

[51] Int. Cl.[6] ..... B65D 33/24

[52] U.S. Cl. ..... 383/95; 383/40; 383/41; 383/66; 383/106; 383/111

[58] Field of Search ..... 383/41, 66, 92, 383/95, 105, 106, 111, 901, 906, 38, 39, 40, 4, 44; 224/148.2, 148.5

[56] References Cited

U.S. PATENT DOCUMENTS

| | | | |
|---|---|---|---|
| 1,291,914 | 1/1919 | Kelley | 383/39 X |
| 1,927,471 | 9/1933 | Salomon | 383/4 X |
| 3,074,451 | 1/1963 | Whitney | 383/106 X |
| 3,078,897 | 2/1963 | Rifkin | 383/40 |
| 3,818,963 | 6/1974 | Whitman | 383/40 |
| 4,466,516 | 8/1984 | Sicoli et al. | 383/4 X |
| 4,836,416 | 6/1989 | Shalgi et al. | 383/906 X |
| 4,934,833 | 6/1990 | Linder | 383/4 |
| 4,988,097 | 1/1991 | Smith et al. | 224/148.2 X |
| 5,035,516 | 7/1991 | Pacheco | 383/41 |
| 5,230,566 | 7/1993 | Jackson et al. | 383/111 X |

FOREIGN PATENT DOCUMENTS

| | | | |
|---|---|---|---|
| 2157552 | 10/1985 | United Kingdom | 383/4 |

*Primary Examiner*—Jes F. Pascua
*Attorney, Agent, or Firm*—M. Reid Russell

[57] ABSTRACT

A container formed to contain and protect from damage one or more fluid sample bags maintained therein. The container is formed from a pair of like sections of strong semi flexible material that may be joined around three sides and are joined along at least one side, to form a pocket for receiving one or more fluid sample bags fitted therein, with the container open side or sides arranged to be closed as with opposing mat type closure stripes that are secured along the sections unconnected sides, proximate to their edges, and are pressed together. A hole or holes are provided through one or both of the sections of material for receiving a port or valve of the fluid sample bag fitted therethrough, and the container unconnected sides of the sections of material each include one of a pair of loops that align with one another and may receive a coupling device, such as a D ring fitted therethrough that may, in turn receive a lock, seal wire, or the like. One of the sections of material, or a portion of one of the sections of material, can be formed from a transparent material, to allow for viewing the container interior, and a gas sample card pocket may be secured to one or both of the container surfaces. Additionally, the container may include an arrangement for providing to an operator a visual indication of when a properly filled condition of a fluid sample bag maintained in the container is achieved.

11 Claims, 6 Drawing Sheets

SAMPLE BAG CONTAINER

BACKGROUND OF THE INVENTION

1 . Field of the Invention

This invention relates to covers or containers for maintaining a specimen container to protect the container and its contents during collection and transport and in particular is for use with gas collection type specimen bags.

2. Prior Art

Many types of containers have been used for the collection of samples and specimens, particularly in a field setting, for later analysis. Of fairly recent times, such containers have generally involved plastic vessels, particularly bags, that are formed from a strong yet flexible plastic material, as by heat welding or otherwise connecting two flat sections of such plastic material along their common edges, to form a closed container that includes a port or valve, fitted into the formed closed bag. A number of such bags have been developed and are currently being marketed under names such as: Teflon and Tedlar Gas Sampling Bags as are available through Forestry Suppliers, Inc.; Saran Gas Sampling Bags as are available through The Anspec Company, Inc.; Teflon and Tedlar Sampling Bags as are available from Chemical Research Supplies; and Cali-5-Bond Gas Sampling Bags manufactured and sold by Calibrated Instruments, Inc., that are all for collection of gas or air samples. Such bags may be manufactured to be transparent or opaque, involve on/off ports or valves, or a straight through connection or connections may also be used in each, and/or may involve a self sealing septum that is mechanically affixed or secured therein with an adhesive for use with a syringe needle, or the like, to receive a quantity of a gas specimen passed therein. Such sample bags are generally filled in a field setting for transport to a laboratory. Such gas specimens are often taken, for example, from a top section of a closed storage tank, a mine, gas or oil well, industrial process stream, land fill site, sanitary waste facilities, utility of industrial smoke stack, chemical or petroleum reactor vessel, gas laboratory and biotechnology reaction chambers, human physiology and respiratory research chambers, remote or local ambient air monitory sites and governmentally regulated workplaces, and the like, and often such collections are made at locations far removed from civilization that must be reached by travel over unimproved roads or by air transport. Accordingly, in practice, a geologist, scientist, engineer, government researcher, or the like, in a field setting, will often obtain specimens from a number of sources and locations, with the individual sample or specimen bags then stored together in less than secure circumstances and must endure travel hazards. In such circumstance, a bag or bags that may represent a large investment in time and energy my be damaged and a specimen contaminated or lost in such transport, resulting in a significant scientific, environmental, health management or financial loss. Such may occur even where the sample or specimen bags, as are used as set out above, are formed to be both strong and reliable. The present invention addresses a need for protecting such sample or specimen bags by an arrangement of protective covers or coverings for containing such bags during transport that reliably insure bag security and in the same instant permit easy collection of the air or gas sample at the point of collection and extraction or evacuation of the sample or specimen at the analytical laboratory, without requiring removal of the protective cover.

SUMMARY OF THE INVENTION

It is a principal object of the present invention to provide a protective cover or covering for one or more sampling or specimen bags as are used in a collection of fluid samples or specimens that can be gas or liquid.

Another object of the present invention is to provide a protective cover or covering for receiving and maintaining against damage one or more sampling or specimen bags and will accommodate one or more fill ports or valves as extend from or are located upon each fluid sampling or specimen bag.

Another object of the present invention is to provide a protective cover or covering that will allow filling of and extraction of a fluid, that can be a gas or a liquid, from a sample or specimen bag contained therein without requiring removal of the cover or covering.

Another object of the present invention is to provide a protective cover or covering to conveniently pass or remove one or more fluid sample or specimen bags that is easily opened along one, two or three sides and can be reliably closed to maintain the security of such fluid sample or specimen bags therein.

Still another object of the present invention is to provide a protective cover or covering having an arrangement for closing and locking an opening into the cover or covering wherethrough a sample or specimen bag is passed to both protect and secure one or more of such fluid sampling or specimen bags therein.

Still another object of the present invention is to provide a protective cover or covering for containing one or more fluid sample or specimen bags that is formed from a strong yet flexible material to contain, protect and flex or bend during filling of a fluid sample or specimen bag or bags positioned therein that includes an arrangement for estimating, by an expansion of the contained sample or specimen bag, when that bag has attained a properly filled state.

Still another object of the present invention is to provide a protective cover or covering for one or more fluid sample or specimen bags that may be conveniently linked together to facilitate handling and transport of numerous bags by a single person.

Still another object of the present invention is an arrangement with the cover or covering to permit suspending the sample or specimen bag while in use at the point of sample collection, during sample extraction at the analytical laboratory or during transport to the analytical laboratory.

In accordance with the above set out objects, the present invention is in a cover for containing a flexible fluid sample or specimen bag, for use with a liquid or gaseous sample, that is conventionally formed from a strong plastic material and may be clear or opaque depending upon what is being collected in the sample bag and including at least one port, valve, or the like, for passing a collected material, such as a gas or liquid, therein, and to prohibit its leaking therefrom. Such gas sample bags are presently available from a number of sources and incorporate different port or valve structures. Such bags are generally intended for use in a field or workplace setting and where collected samples or specimens can be subject to rough handling during transport.

Additional to a manufacture of the cover of the invention from a thick or heavy yet flexible material such as a cotton, vinyl, vinyl backed, canvas, duck material, nylon, and the like, or from other appropriate material, the invention may also include in one surface, a window formed from a clear material to allow for a visual inspection of contained sample bag which clear material may be covered by an opaque flap, or the like, to block sun exposure. The cover is preferably constructed to include reinforced holes that are formed through the cover for accommodating a fill port, valve, or other attached accessory device, that extends from each sample bag as is contained therein. Such hole reinforcement can be provided as by attaching grommets to the edges of hole or holes, by stitching, around such hole, or the like, to both provide edge reinforcement and to facilitate the sample gas bag port, valve or other attached accessory device being slid therethrough. Additionally, the cover is preferably arranged to be opened along one side, to freely pass a gas sample bag therein, but may be openable around two or even three of its four sides, as desired, and preferably includes a closure arrangement arranged across each opening, such as opposing Velcro® type fastening stripes that are press coupled together to hold the opposing cover edges together. Such closure arrangement can be further secured by an inclusion of opposing loops or other closure devices extending from the opening edges that receive D rings, or the like, fitted therethrough to, in turn, receive a lock, safety seal wire or the like, secured therethrough to maintain cover edges together during transport, and to verify the integrity of a sample. Additionally, a section of a clear material can be attached to form a pocket as by sewing the section around three of its edges to an outer surface of the cover. Which pocket is to receive a card that can be marked appropriately for identifying a specimen and information, such as sample, number, location, time, date, the name of the sampling technician, and the like.

A transparent window may be included in one of the container surfaces, or that surface may be formed from a clear material, that material may be itself covered by an opaque sun blocking, flap the clear material to provide for inspection of the contained gas specimen bag, and may include an arrangement for gauging when a gas sampling bag contained therein is filled. Such estimating arrangement may be a pair or more of parallel wide lines or bars with a first bar of the pair formed immediately on or just inside of a cover edge and, with the other or second bar of the pair spaced inwardly therefrom a set distance as determined by the size and type of gas sample bag as is to be contained in the container of the invention. The spacing distance between the first and second wide lines or bars is to illustrate to an observer stationed just above the bag as the gas sampling bag is filled in a field setting, cover expansion such that to the viewer, the second bar will appear to have moved towards the first bar as the cover rises. With, when the cover has lifted to where the gas sample bag is properly filled, the first and second bars will appear to the viewer to touch, or nearly touch, indicating that the gas sampling bag has been filled to a design pressure and volume. Which pressure and volume may be verified by attaching an appropriate gauge to the valve end to sample the gas pressure within the bag.

DESCRIPTION OF THE DRAWINGS

In the drawings that represent best modes for carrying out the invention.

DETAILED DESCRIPTION

Figure 4:
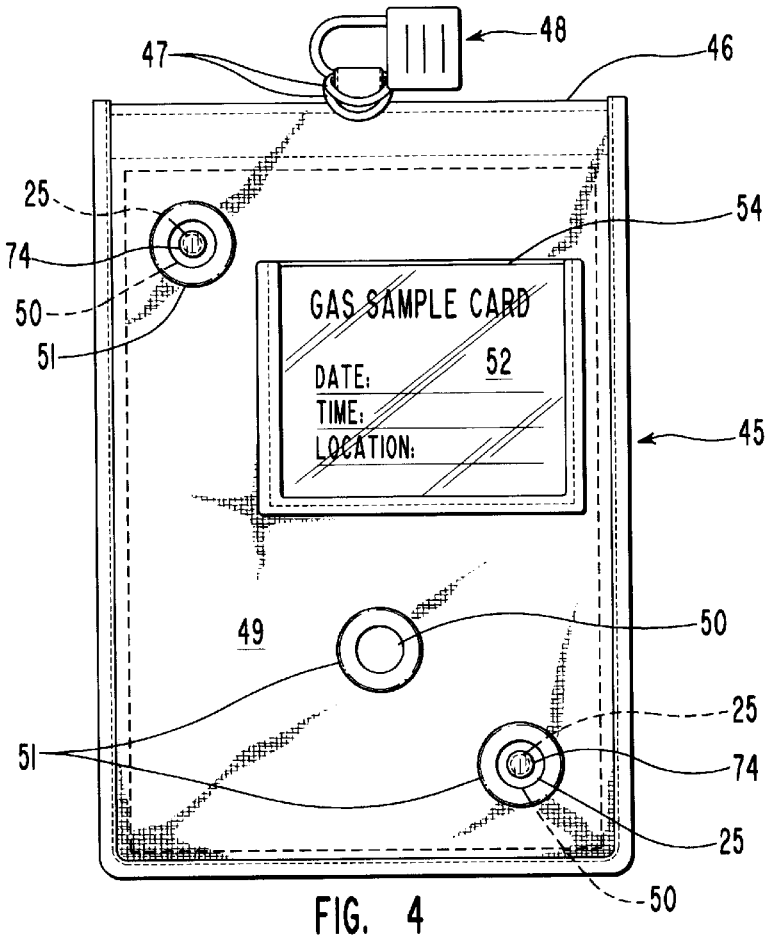
FIG. 4 is a top plan view of a single gas sample bag container of the invention that has a rectangular shape to accommodate a rectangular shaped gas sample bag and includes a plurality of holes formed through a top surface that each include a grommet secured therearound with one of the holes to receive a gas sample bag port or valve fitted therethrough, and showing the cover as formed from a fabric material that may be reinforced with lamination or support backing, is open across a top end, and includes a clear section of material attached to the cover surface as a pocket and showing a sample card fitted therein, and showing loops secured to extend from the cover opening edges that each receive one of a pair of D rings and showing a lock secured through the D rings.

A gas sample or specimen bag container of the invention, hereinafter referred to as container, is shown as a double container 10 in FIGS. 1 and 2, as a rectangular container 45 in FIG. 4, as a square container 55 in FIG. 5, and as a rectangular containers 65, that is openable around three sides, in FIG. 6 and as a foldable rectangular container 80 in FIG. 7. Shown in FIGS. 1 and 2, the container 10 is formed, respectively, from a pair of top and bottom, flat rectangular sections of material 11 and 12, that are each shown as being fabric, and are preferably a somewhat flexible fabric, such as canvas, cotton, nylon, or the like. The sections of material, however, it should be understood, could be other appropriate material, such as a strong plastic, for example, and may be clear or opaque, within the scope of this disclosure. Shown therein, the container 10 is preferably formed by connecting opposing edges of the sections of material 11 and 12 together around three sides as by sewing them together to form an interior cavity or pocket, and having an open end 13 that is to receive, respectively, a square fluid sampling bag 14 and a rectangular fluid sampling bag 15 fitted therein. Such fluid sample can be a gas or liquid and gas sample bags as are usable with the container, are commercially available from a number or sources, as for example: Teflon and Tedlar Gas Sampling Bags available through Forestry Suppliers, Inc.; Saran Gas Sampling Bags available through The Anspec Company, Inc.; Teflon and Tedlar Sampling Bags available from Chemical Research Supplies; and Cali-5-Bond Gas Sampling Bags manufactured and sold by Calibrated Instruments, Inc. Such sample bags are all for collection of gas or air samples, with the container 10 arranged to receive each of the different sampling bags, accommodating different hardware arrangements and hardware locations for each of the gas sampling bags. Such bags may be manufactured to be transparent or opaque, involve on/off ports or valves in each and/or a self sealing rubber septum for use with syringe needles, or the like, to provide for passing a quantity of a gas specimen therein. The shape and dimension of the container 10 of the invention is, of course, dependent upon the fluid sample bag or bags as it is intended to contain, and accordingly, it should be understood, the shape and relative dimensions of the containers 10, 45, 55, 65 and 80 are not limited to the configuration shown and should be taken as examples only, and may be arranged to accommodate other configurations of sample bags, within the scope of this disclosure.

Figure 2:
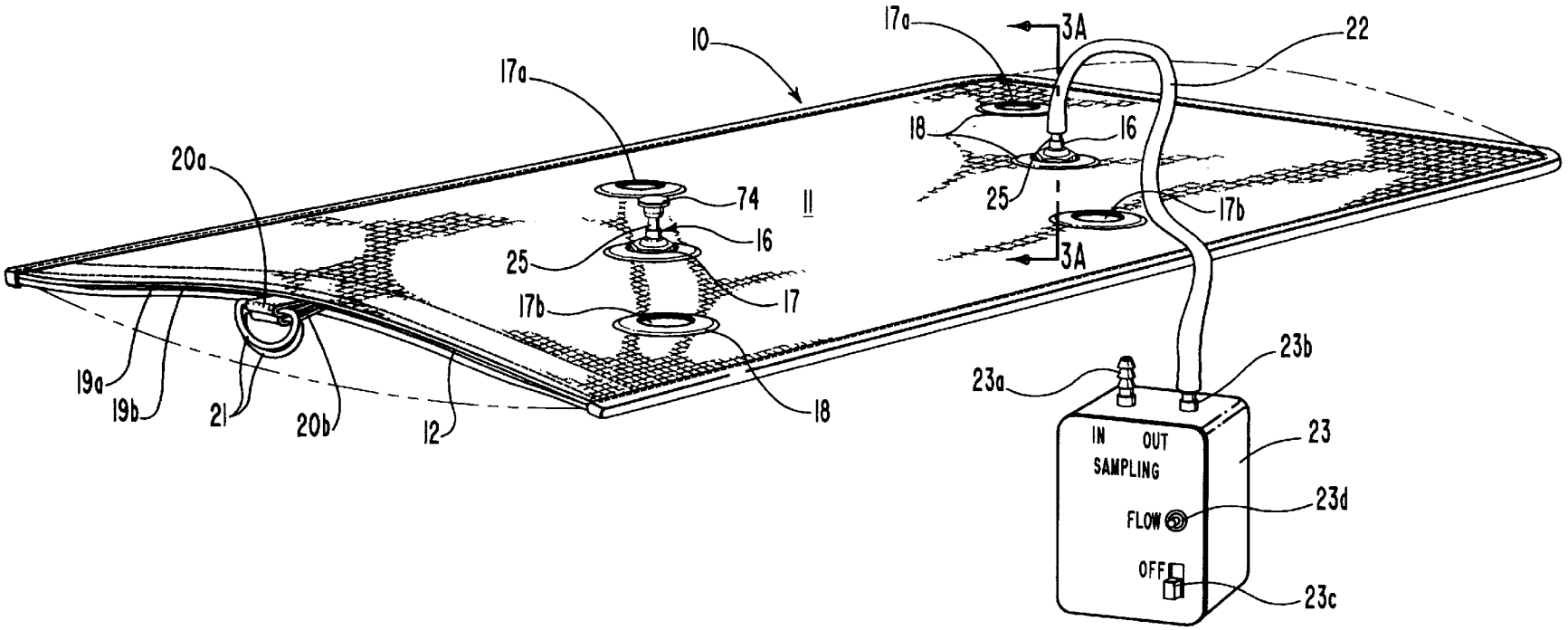
FIG. 2 is a view of the cover of FIG. 1 showing gas sample bags fitted therein and showing a feed hose connected to a gas sample bag inlet port or valve whose other end is connected to a gas sampling pump.
Figure 3A:
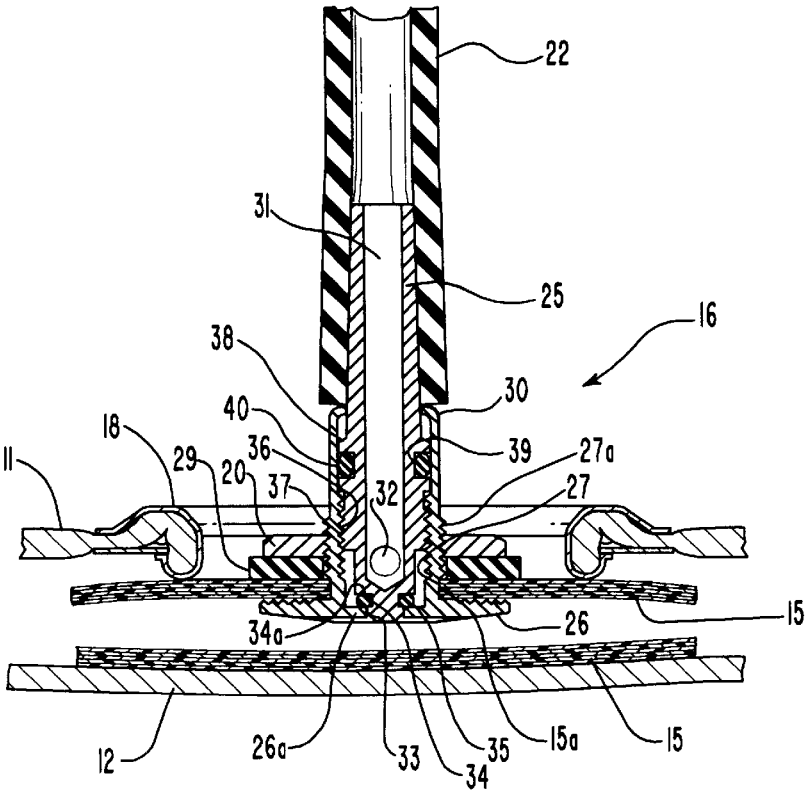
FIG. 3A is an enlarged side elevation sectional view of the inlet port or valve and line end taken along the line 3A—3A of FIG. 2, showing the port or valve in an open attitude.
Figure 3B:
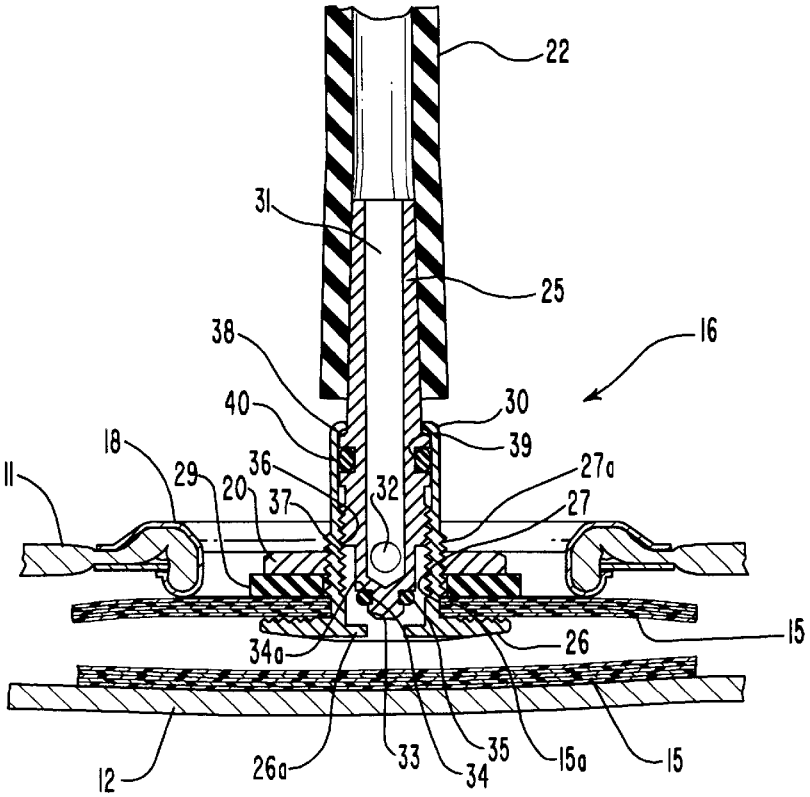
FIG. 3B is a view like that of FIG. 3A only showing the port or valve in a closed attitude.

Such fluid sample bags 14 and 15 are for collecting and maintaining specimens for transport to a test facility and accordingly include fill ports or valves 16 that provide for filling the bag through a line 22, or the like. Such line 22 connects, as shown in FIGS. 3A and 3B, to pass a specimen or sample from an ambient source, such as from a sampling source under a slight pressure, such as a vacuum pump 23. As shown in FIG. 2, such pump 23 preferably includes in and out ports 23*a* and 23*b*, respectively, and may run continuously, or is to be turned on and off at power switch 23*c*. When operated, pump 23 provides for flow control therethrough at a toggle switch 23*d*. Sample bag or bags may, however, be filled from another source, such as by a use of a hypodermic syringe whose needle end is fitted into a sealing rubber type pad that is mechanically secured, are adhesive bonded or the like, to the gas sampling bag, not shown, or the like. The type of port or valve 16 that is shown and described hereinbelow with respect to FIGS. 3A and 3B is an example of a commonly used valve as is suitable for inclusion with the gas sample bag that the containers 10, 45, 55, 65 and 80, are suitable for use with, where such port or valve is to close automatically as by manual adjustment or clamp device when separated from a fill line, or the like. For purposes of this disclosure, a single fill port or valve 16 is shown, in an open attitude in FIG. 3A and in a closed attitude in FIG. 3B. The port of fill valve 16 as was selected was only one of a multitude of such ports or fill valves as are commercially available and suitable for use with container 10, and, it should be understood, a number of other such ports or fill valves are suitable for inclusion with gas sample bags that the container 10 can be used with.

To accommodate each port or valve 16 stem 25 of a gas sample bag fitted therein, the container 10, and the other container embodiments set out below, include one hole 17 formed through the top section of material 11 for each port or valve 16 that extends from the bag top face. To illustrate a potential for use of the container 10 with other varieties or types of sample bags, not shown, additional holes 17*a* and 17*b* are shown formed through the container top section of material 11 that are on a diagonal from the center hole 17. Such other holes 17*a* and 17*b* can be otherwise positioned or eliminated depending upon the gas sampling bag or bags as the container 10 is intended for use with, within the scope of this disclosure. The holes 17, 17*a* and 17*b* are preferably reinforced by fixing metal grommets 18, sewn grommets, or the like to the edges thereof to both prohibit fraying of the hole edges and to facilitate a bag port or valve 16 stein 25 sliding freely therethrough.

Figure 1:
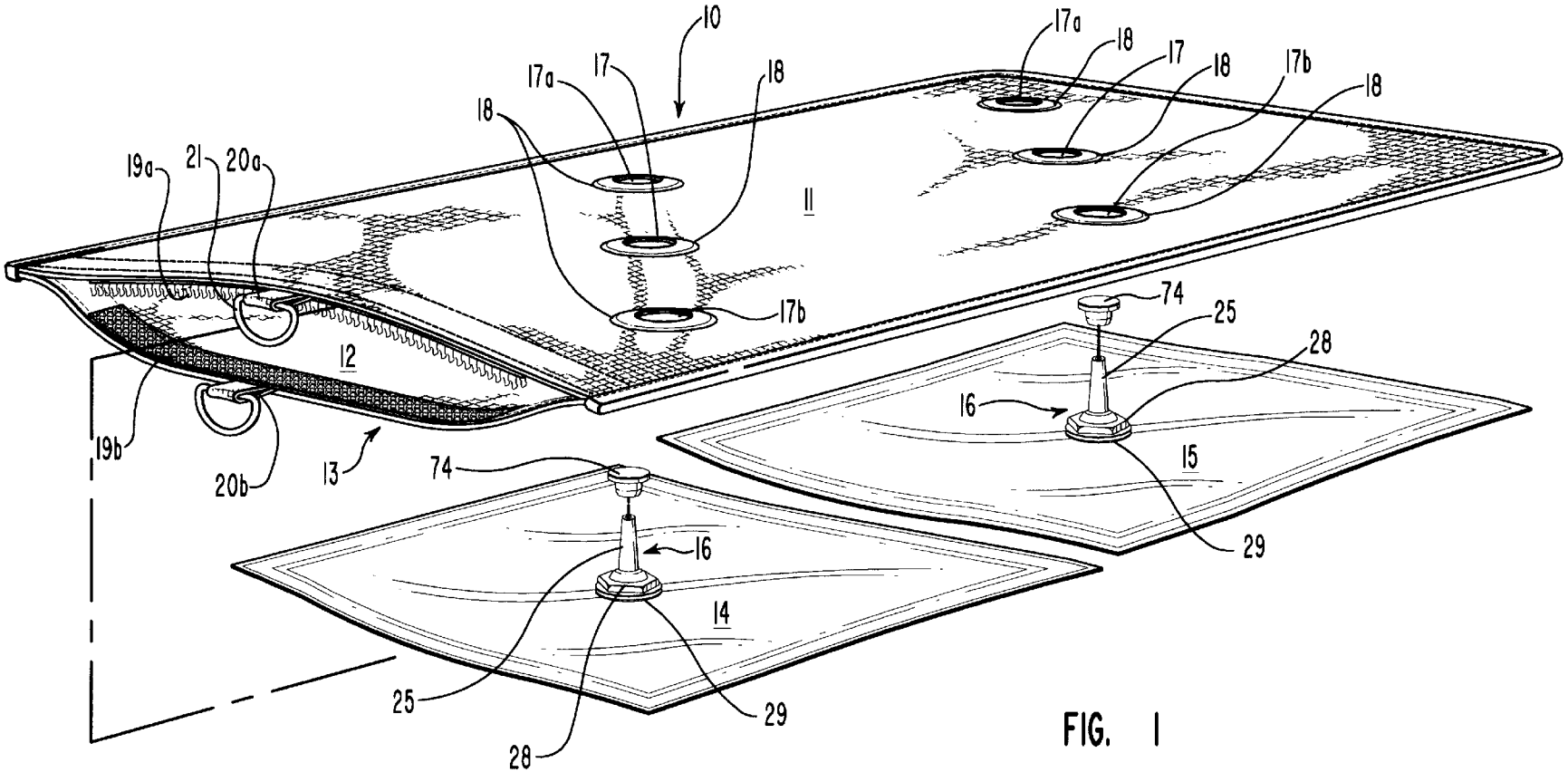
FIG. 1 is a side elevation perspective view showing the invention in a sample or specimen bag container and showing an open end thereof with a pair of gas sample or specimen bags aligned for fitting, in end to end relationship, into the container.

Shown in FIG. 1, the container 10 open end is sealable by pressing together opposing mat and barb couplings sections or stripes 19*a* and 19*b*, respectively, that are preferably Velcro ® type fastening stripes, but may be other closure arrangements within the scope of this disclosure. The coupling stripes 19*a* and 19*b* are thereby releasably connected together, closing off the container open end 13, as shown in FIG. 2. For maintaining the closed container 10 against opening during transport opposing loops 20*a* and 20*b* are preferably included to extend outwardly from edges of the container top and bottom sections of material 11 and 12, respectively, and can each receive a D ring 21 fitted and secured therethrough. Such D rings 21 are shown also in FIGS. 4 and 5, which D rings can receive a lock passed therethrough and closed, or a security seal wire, or the like, so as to secure the sampling bag in the container 10 during can receive transport. As required, the container 10 interior may be lined and, of course, can be formed from different colors of materials.

FIGS. 3A and 3B are included to illustrate a type of port or valve 16 as is suitable for inclusion with a sampling bag that the containers 10, 45, 55, 65 and 80 can be used with. Such valve, as shown, or other accessory devices or rubber pad, are for use in filling the sampling bag from a source such as pump 23, from a hypodermic, or the like. Valve 16, may, however, be any appropriate valve to include, but not limited to, a "Twist Type", "Double O Ring", "Straight Through Connection" (STC), "Quick Disconnect Straight Through Connection", "Luer-Fit Valve With Quick Mate Connector", mechanically affixed replaceable septum holder, "Stop Cock", or any other appropriate valve or accessory device as is presently marketed or will be marketed in the future. For this disclosure, port or valve 16 is shown as a "Double O Ring" valve that is currently marketed by BGI Incorporated of Waltham, Mass., for example.

Shown in FIG. 3A, port or valve 16 includes smooth stem 25 and has an end of tube 22 fitted thereover. To mount the port or valve 16 to the gas sampling bag 15 during manufacture, as shown in FIGS. 3A and 3B, a neck 27, that extends from a valve base 26, is fitted through a hole 15*a* that has been formed through a bag top section. The neck 27 is arranged to receive a nut 28 turned thereover to urge the base 26 upper surface and nut 28 lower surface against sealing washers 29. The contact of the respective surfaces compress the sampling bag 15 edge of hole 15*a* into the sealing washers 29 sealing it into the bag. The neck 27 is longitudinally open therethrough and, in addition to being externally threaded at 27*a* to receive the nut 28 turned thereover, is straight and smooth walled to a top end. The neck 27 top end is inturned at 30 to engage the surface of stem 25. The stem 25 is longitudinally open at 31 into a lower end port 32 that is located above a closed end 33. The closed end 33, as shown, is, in turn, stepped inwardly from a lower O ring seat 34 wherein a lower O ring 35 is fitted. The O ring 35 to also engage an upper wall 34*a* that, in turn, has been stepped outwardly to a greater diameter than the distance or diameter between edges 26*a* around the lower end of the longitudinal opening through the base 26. So arranged, the lower O ring 35 surface will engage the base edges 26*a*, sealing thereagainst when the stem 25 is turned into the base 26 neck 27, to close off the port or valve 16, as set out below.

To provide for an opening and closing of the port or valve 16, the base 26 neck 27 is internally threaded at 36 to receive threads 37 of stem 25 that is turned therein. When, as shown in FIG. 3A, the stem is turned into the neck 27 the port or valve 16 will be closed, and, with the stem 25 turned out of the base 26 neck in FIG. 3B, the port or valve will be open. A shoulder 38 is formed around a mid-section of the stem 25 to prohibit the stein 25 from being turned out of the base 26 neck 27. The stem 25 has a greater diameter than the distance across the opposing edges of the neck 27 that have been inturned at end 30. For sealing the stem 25 against leakage therealong and out of neck 27, an upper O ring seat 39 is formed alongside of the inturned end 30, below the shoulder 38 that receives an upper O ring 40 fitted therein. The O ring 40 to compress to seal against the inner smooth wall of the neck 27 opening. Accordingly, as shown in FIG. 3A, the stem 25 is turned out of the base 26 neck 27 to open the port or valve 16, thereby passing a flow therethrough, and as shown in FIG. 3B, is turned into the base neck 27 to close off flow through the port or valve 16.

It should be understood that the containers 10, 45, 55, 65 and 80, of the invention are suitable, or can be adapted as needed for use with, a sampling bag as described hereinabove, or with other like bag, within the scope of this disclosure. Container 45 is shown in FIG. 4 as being a rectangular container that is open along a top end 46 and preferably includes a closure arrangement that is like the Velcro® type closure stripes 19*a* and 19*b* shown in FIG. 1. This embodiment also preferably includes a pair of opposing loops 47, though only one loop is shown, that are like the loops 20*a* and 20*b* shown and described above with respect to FIGS. 1 and 2. Each loop 47 is preferably fitted with a D ring 21, or other closure device, and a pad lock is herein shown fitted through the D rings, for maintaining the security of the container 45 against opening. The container 45 includes a plurality of holes 50 formed through a top section 49 that each have been fitted with a grommet 51. The holes 50 with attached grommets 51 are like the holes 17 and grommets 18 as described above. So arranged, the holes 50 are to receive ports or valves 16, or the like, fitted therethrough, with two of the holes 50 shown as containing stems 25 that have been closed off with caps 74. Further to container 45, a pocket 52, that is preferably formed from a square flat section of a clear material, such as a clear plastic, is connected to the top section 49, as by sewing it around three sides, shown at 53. A pocket is thereby formed that has an open top end to receive a card 54 fitted therein. Card 54 can include blanks printed thereon to be filled in for identifying the specimen or sample contained in a sample bag maintained in container 45, and other appropriate information.

Figure 5:
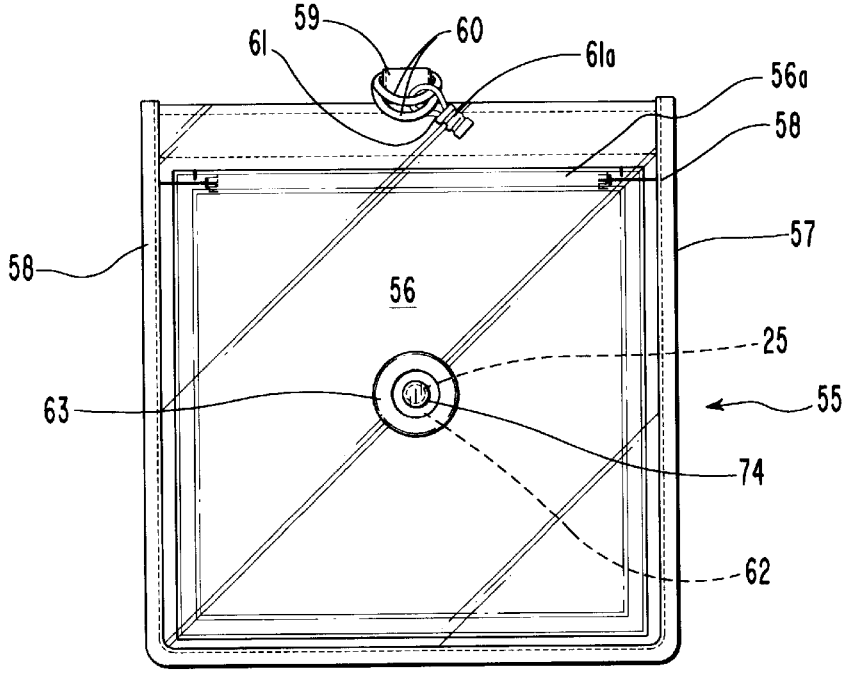
FIG. 5 is a view like that of FIG. 4 only showing a square embodiment of a container of the invention formed from two sections of material joined around three sides arranged for containing a square gas sample bag and showing one of the two sections of material formed from a transparent material to allow for visual inspection of a gas sampling bag contained therein, and showing a security wire fitted through the container D rings with a security seal press fitted thereon.

FIG. 5 shows container 55 as a square container that is formed also from top and bottom sections of material 56 and 57, respectively, with the top section of material shown formed from a clear material, such as a clear plastic material, and may include an opaque flap 56*a* shown rolled upon itself, to fold over the clear material to block the contained sample bag from exposure to sun light. To form container 55, the two sections of material are preferably stitched together at 58 around three sides, leaving an open top end that, like the containers 10 and 45, preferably includes a pair of opposing loops 59. The loops 59 extend outwardly to receive D rings 60, other closure devices, or the like. The D rings 60, as shown, can themselves receive a lock or a seal wire 61 fitted therethrough and through a seal 61*a*, such as a lead safety seal, that has been compressed to lock it onto the wire 61. Like the above described containers 10 and 45, container 55 also includes a hole 62, shown in broken lines, formed through the top section of material 56 that has been reinforced with a grommet 63, and as shown in broken lines, includes a port or valve stem 25 fitted therethrough, with a cap 74 fitted onto the stem 25 top end.

Figure 6:
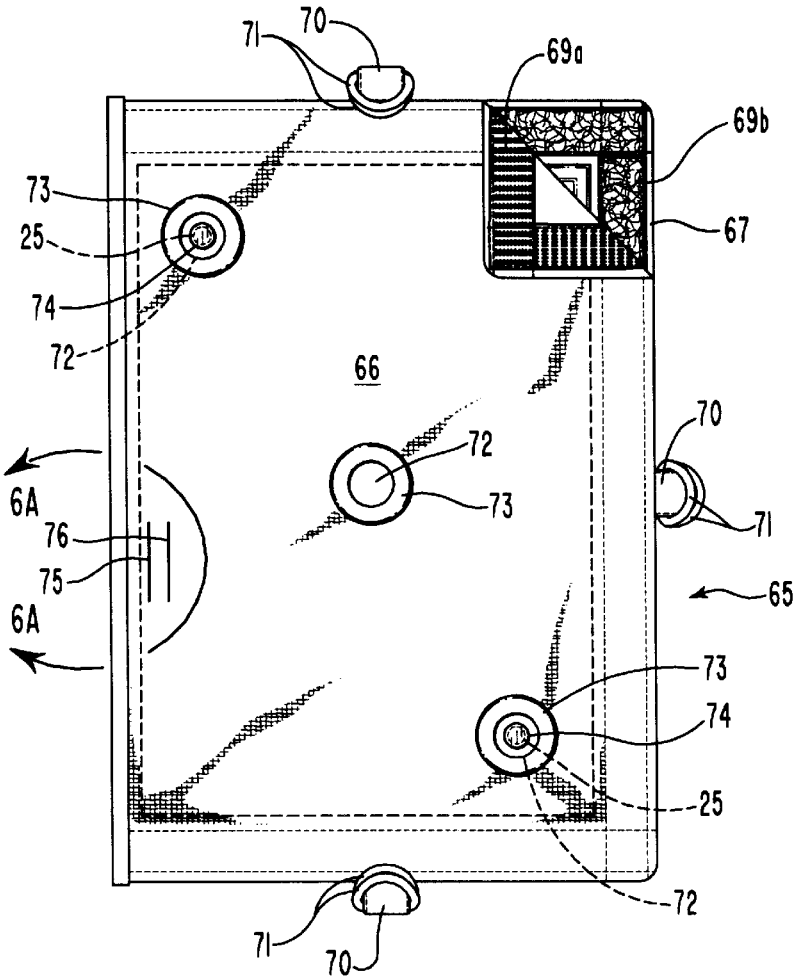
FIG. 6 is a view like that of FIG. 4 except a container is shown that can be opened around three of its four sides and showing Velcro® type fastener stripes secured onto opposing unconnected container edges for joining the opposing edges together to contain a gas sample bag therein and showing a pair of spaced parallel lines formed onto the container surface, with one of the pair of lines being just inside of the junction of the sections of material closed side and with the second of the pair of lines being just inwardly therefrom.

FIG. 6 shows another embodiment of the invention as a rectangular container 65 that is preferably formed by joining two like sections of material, shown herein as top and bottom sections 66 and 67, respectively. The sections 66 and 67, respectively, are preferably each a fabric material, that are connected along common edges to have an open interior. In this embodiment, rather than a connection of the top and bottom sections around three common edges, the sections are shown joined along one common long edge or side only, as by sewing, as shown at 68. So arranged, the remaining three common edges or sides are shown to include opposing stripes of a Velcro® type hook and matt sections 69*a* and 69*b*, respectively, that are secured therealong to be adjacent to the opposing section edges and are to be pressed together to couple the container 65 along three sides, as shown. For securing the three side together, each side is shown to include a pair of opposing loops 70 that individually extend outwardly from edges of each of the sections of material 66 and 67 unconnected sides and may include D-rings 71, or other appropriate devices, fitted therethrough that, in turn, may each receive a lock, wire safety seal wire, or the like, as shown above, and described with respect to the other D rings and seal arrangements. Also, the D-rings or ring may be individually used as a hanger. Like the above described other containers 10, 45 and 55, container 65 preferably includes one or more holes 72 formed through the top section of material 66, that are also preferably reinforced with grommets 73 to receive a stein or stems 25, shown in broken lines, fitted therethrough that are shown closed over with caps 74.

Figure 6A:
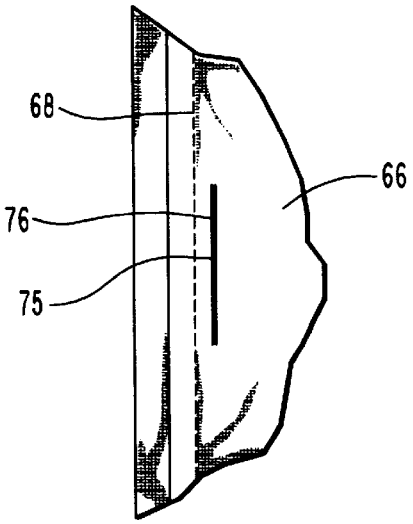
FIG. 6A is an enlarged section taken within the line 6A—6A of FIG. 6 showing, as a person directly above would see, the container after the gas sample bag has been filled, with the elevated container surface alongside of the junction of the two sections of material elevating also the second line of FIG. 6 to where it has appeared to have moved to be in proximate contact.

Additionally, shown with container 65, and as may be included with the other containers 10, 45, 55, and 80 of the invention, parallel inner and outer wide lines or bars 75 and 76, respectively, as shown in FIGS. 6 and in an enlarged perspective view of FIG. 6A, are formed or fixed onto the top section of material 66, adjacent to and spaced from the stitches 68. Though, it should be understood, a plurality greater than a pair of bars could be so fixed on the top section and used for determining the inner sample bag filled state, within the scope of this disclosure. As shown, the inner bar 75 is closest to stitches 68, with the outer bar 76 spaced therefrom. Which spacing distance is governed by a calculation of the expansion the container 65 will undergo when a sample bag, as is contained there, is filled. In a filling of such sample bag, the container top and bottom section will spread apart, as shown in FIGS. 3A and 3B, tending to elevate material along a sewn edge 68, at an angle from which stitches 68, as shown in FIG. 6A. During which elevation, an observer looking down on the container, will see the inner and outer wide lines or bars 75 and 76 as appearing to close together, the outer bar 76 appearing to move towards the inner bar. Accordingly, by a selection of spacing distance between which inner and outer wide lines or bars, when the gas sample bag maintained in container 65 is just filled, the outer bar 76 will appear to the observer to be proximate to or just in contact with the side of the inner bar 75, indicating that filled condition.

Figure 7:
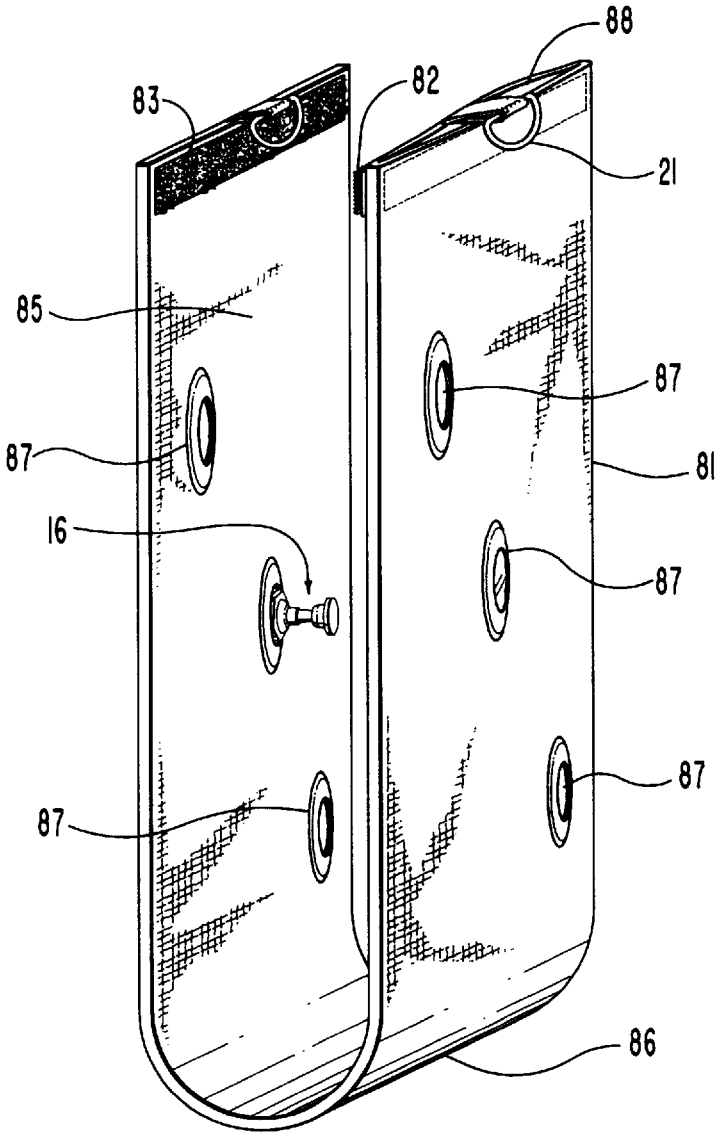
FIG. 7 is a profile perspective view taken from the side to show a rear face of a long container of the invention showing Velcro® type fastener sections or stripes secured, respectively, across the container bottom portion and the container top end portion, with, in broken lines, the container lower portion shown folded across its front to couple the respective fastener stripes together.

Container 80 is shown in FIG. 7 as having a rectangular body 81 that can be folded, shown at 86, and that fold maintained by a coupling of opposing Velcro® type fastening sections or stripes 82 and 83, respectively, as have been secured to a rear face 84 of a container body 81. The container 80 is suitable for maintaining different sizes of sample bags and includes a valve hole 87 formed through a front face 85 of body 81. Which valve hole 87, it should be understood, is like the other valve holes 17, 17*a*, 17*b*, 50, 62 and 72, set out and described hereinabove, for receiving a port of valve of the sample bag fitted therethrough. The container 80 is preferably open across end 88 to receive the sample bag fitted therein with, by folding along fold 86, as shown in broken lines, that open end 88 is thereby closed off, maintaining the sample bag therein.

While preferred embodiments of my invention in a gas sample bag container and its use have been shown and described herein, it should be understood that the present disclosure is made by way of example only and that variations and changes thereto are possible without departing from the subject matter coming within the scope of the following claims, and a reasonable equivalency thereof, which claims I regard as my invention.

I claim:

1. A sample bag container comprising, a pair of like shaped flat sections of material that are connected together at common edges along at least one side and include coupling means for releasably connecting the other common edges of the sections of material together so as to close said sections of material, forming an inner pocket between said sections of material having dimensions containing a conventional fluid sample bag; and at least one hole formed through one of said sections of material receiving a fluid sample bag port or valve fitted therethrough that includes a neck that connects to a transfer line to pass a gaseous material therethrough and is configured as a one way valve to include internal sealing means for closure against an unwanted back flow of said gaseous material.

2. A container as recited in claim 1, further including means for reinforcing each hole formed through one of said sections of material.

3. A container as recited in claim 1, wherein the sections of material are both stiff cloth.

4. A container as recited in claim 1, wherein the sections of material are a section of stiff cloth and a section of relatively thick plastic material.

5. A container as recited in claim 4, wherein the sheet of plastic material is transparent and includes a covering flap to protect the contained fluid sample bag from direct sunlight.

6. A container as recited in claim 1, wherein the coupling means are fastener stripes, including a strip of mat material and a strip of hook material, which stripes are individually mounted to oppose one another along and adjacent to the unconnected ends of the sections of material, which said stripes are to connect when pressed together.

7. A container as recited in claim 1, further including a flat section of a transparent material for securing along three sides to one of the sections of material to form a pocket to receive a sample card fitted therein.

8. A container as recited in claim 1, further including a pair of loops, with each loop of a pair secured across one end of each said sections of material, at their unconnected side or sides, with said loop of each pair of loops aligning with one another; and a ring means for fitting through at least one loop of a pair of loops.

9. A container as recited in claim 8, wherein the ring means is a D ring, and a D ring is provided for fitting through each loop of a pair of loops, with the D rings of the pair aligned to receive a lock or seal wire fitted therethrough.

10. A container as recited in claim 1, further including a means for indicating to an observer the filled state of the fluid sample bag maintained in the container including a pair of straight bars formed on an outer surface of one of the sections of material, with an inner line of said pair of bars formed parallel and adjacent to the junction of the pair of sections of material and with an outer bar of said pair of bars spaced a distance therefrom whereby, when a fluid sample bag maintained in the container is at a desired filled state, the portion of the sections of material along their connection will have spread apart at an angle to said connection whereby an observer, looking at said pair of bars, will see said pair of bars as appearing to have moved together.

11. A container is recited in claim 1, wherein the connected flat sections of material are arranged to be foldable thereacross; and the coupling means are at least two sections or stripes of coupling material consisting of, respectively, sections of mat material and a hook material that will connect when pressed together, with one section or stripe or coupling material secured to a rear flat section of material along the container open end and the other section or stripe of coupling material secured along said rear face proximate to said container opposite closed side and extending to a midsection of said rear face.

* * * * *